US005940037A

United States Patent [19]

Kellerman et al.

[11] Patent Number: 5,940,037

[45] Date of Patent: Aug. 17, 1999

[54] STACKED PATCH ANTENNA WITH FREQUENCY BAND ISOLATION

[75] Inventors: Francis William Kellerman, Brentwood; William Henry Harned, Kensington; Richard Alexander Mullins, Hampton, all of N.H.

[73] Assignee: The Whitaker Corporation, Wilmington, Del.

[21] Appl. No.: 08/841,060

[22] Filed: Apr. 29, 1997

[51] Int. Cl.[6] ..... H01Q 1/38

[52] U.S. Cl. ..... 343/700 MS

[58] Field of Search ..... 343/700 MS, 745, 343/873, 705, 713, 795, 872, 897; H01Q 1/38

[56] References Cited

U.S. PATENT DOCUMENTS

| | | | |
|---|---|---|---|
| 4,089,003 | 5/1978 | Conroy | 343/700 MS |
| 5,153,600 | 10/1992 | Metzler et al. | 343/700 MS |
| 5,155,493 | 10/1992 | Thursby et al. | 343/700 MS |
| 5,184,143 | 2/1993 | Marko | 343/749 |
| 5,400,041 | 3/1995 | Strickland | 343/700 MS |
| 5,572,222 | 11/1996 | Mailandt et al. | 343/700 MS |

FOREIGN PATENT DOCUMENTS

| | | | |
|---|---|---|---|
| 0 362 079 A2 | 4/1990 | European Pat. Off. | H01Q 9/04 |

*Primary Examiner*—Frank G. Font
*Assistant Examiner*—Layla G. Lauchman

[57] ABSTRACT

A stacked patch antenna (1) is constructed with separately fed patch elements (2, 3) coupled at their respective null points with a coaxial feed (9), the coaxial feed (9) feeding a first patch element (2), a portion of the first patch element (2) connecting its null point with a natural feed point to be fed by the coaxial feed (9), and a second patch element (3) being referenced to ground by the coaxial feed (9).

15 Claims, 6 Drawing Sheets

STACKED PATCH ANTENNA WITH FREQUENCY BAND ISOLATION

FIELD OF THE INVENTION

The invention relates to a stacked antenna with stacked patch elements with inherent isolation between operating frequency bands.

BACKGROUND OF THE INVENTION

A typical patch element of a patch antenna is in the form of a flat rectangular or circular metal microstrip or patch on the surface of a dielectric, with the dielectric on a conducting ground plane. The patch element acts as a parallel plate, microstrip transmission line serving as an antenna by giving in-phase linearly or circularly polarized radiation. The patch element is fed, for example, by a coaxial feed. A coaxial feed comprises, a conducting central conductor encircled concentrically, first, by a dielectric, and then, by an outer conductor serving as a conducting shield. The ground plane of the typical patch element is connected to the shield. In the past, a known method of feeding the patch element required the center conductor of the coaxial feed to connect at a natural feed point on the patch element.

The natural feed point on a patch element is located closer to one edge of the patch element. A typical null point is on a polar axis of symmetry for the patch element.

A stacked antenna, is of compact, low profile construction, with stacked patch elements operating at separate frequency bands. A patch element that is directly fed by a coaxial feed has its ground plane connected to a portion of the coaxial feed that is referenced to ground. The stacked patch element lacks inherent isolation of its operating band of frequencies due to the use of a common feed. Accordingly, the patch elements of a stacked patch antenna are poorly isolated, which increases the complexities of tuning and frequency band separation by adding circuit components.

In the past, it was unknown to couple null points of stacked patch elements with a coaxial feed, since excitations fed at the null point tend to reform, before being radiated, rendering the patch element ineffective as a normal mode antenna.

SUMMARY OF THE INVENTION

According to the invention, separately fed patch elements of a stacked patch antenna couple at their respective null points with a coaxial feed. Null point coupling with a coaxial feed provides the patch elements with isolation between operating bands of frequencies.

According to an embodiment of the invention, each patch element that is directly fed, by a coaxial feed, is coupled at its null point to the signal feed by a portion of the patch element. Said portion of the patch element connects the null point with a natural feed point on the patch element. According to an embodiment of the invention each patch element that directly couples to the coaxial feed, is inductively coupled at its null point to a ground shield of the coaxial feed. In turn, the ground shield of the coaxial feed presents an inductance to ground referenced at a ground plane of the antenna. A specific characteristic impedance coupling of the null point is provided for isolation between operating bands.

An embodiment of the invention will now be described by way of example with reference to the accompanying drawings, according to which:

DETAILED DESCRIPTION

Figure 1:
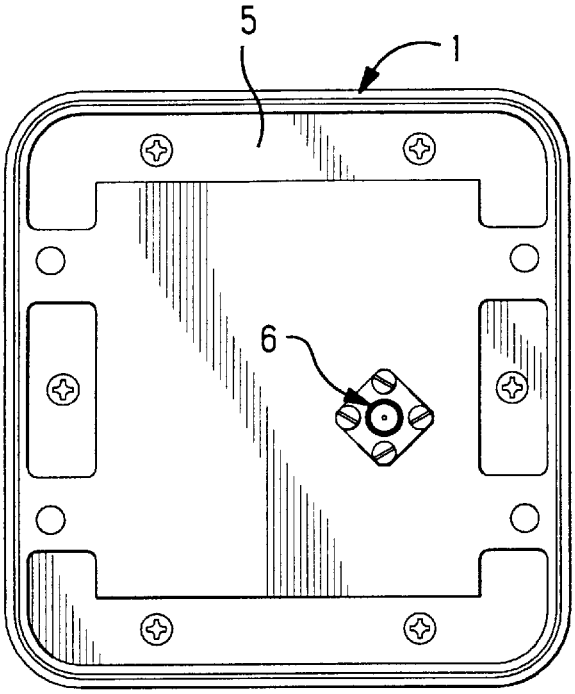
FIG. 1 is a bottom view of a stacked patch antenna.
Figure 2:
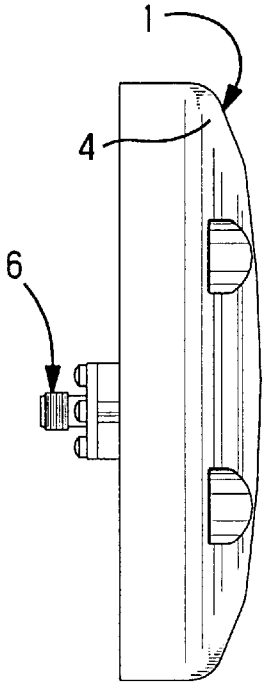
FIG. 2 is a side view of the antenna as shown in FIG. 1.
Figure 3:
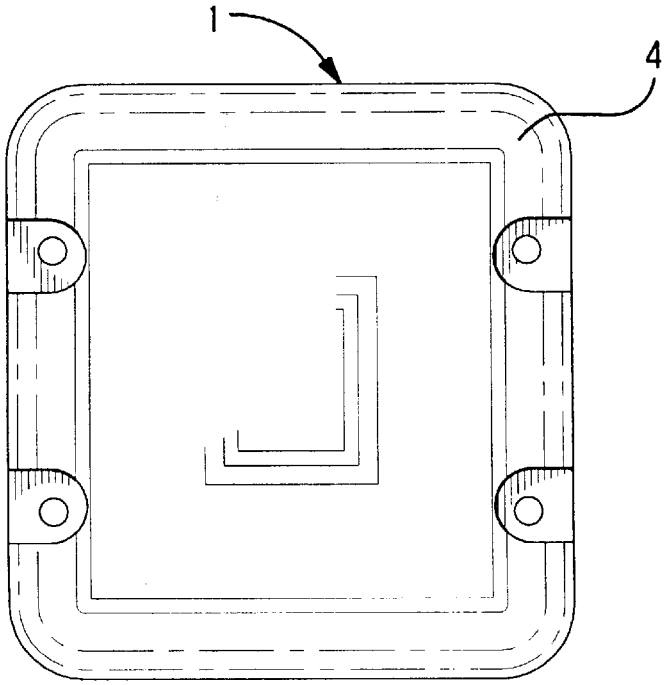
FIG. 3 is a top view of the antenna as shown in FIG. 1.
Figure 4:
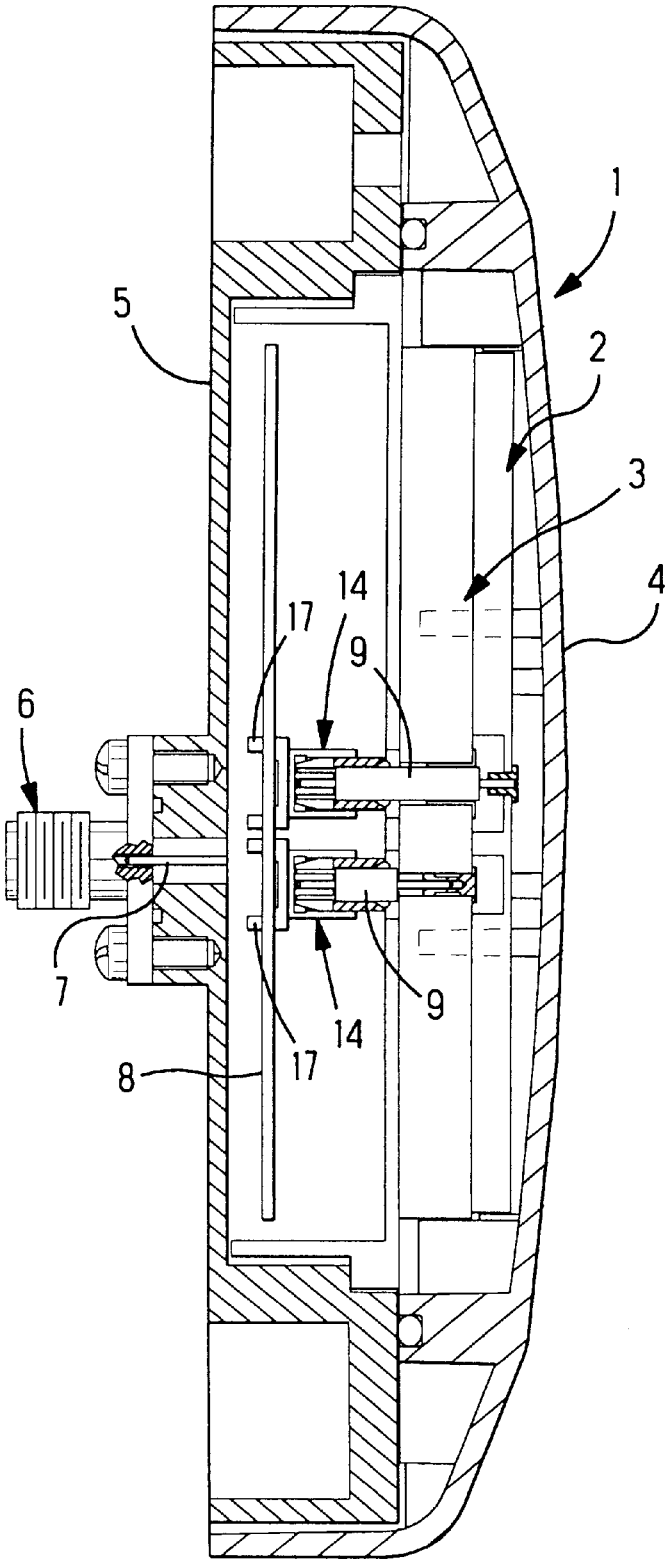
FIG. 4 is an enlarged side view in cross section of the antenna as shown in FIG. 2.

With reference to FIGS. 1–4, a stacked patch antenna 1 comprises, at least one, first, upper patch element 2 and at least one, second, lower patch element 3 enclosed by a radome 4 and a conducting base 5 that nests within an open bottom of the radome 4. The base 5 comprises a coaxial connector 6 having an insulated central electrical contact 7 that provides a feed through connection that provides an access to a circuit board 8, shown edgewise in FIGS. 4 and 13. The patch elements 2 and 3 comprise, separate antennas operating at separate frequency bands. Each patch element 2, 3 is directly fed, for example, by a separate feed 9 for the upper patch element 2, and, for example, by a separate feed 9 for the lower patch element 3.

Figure 11:
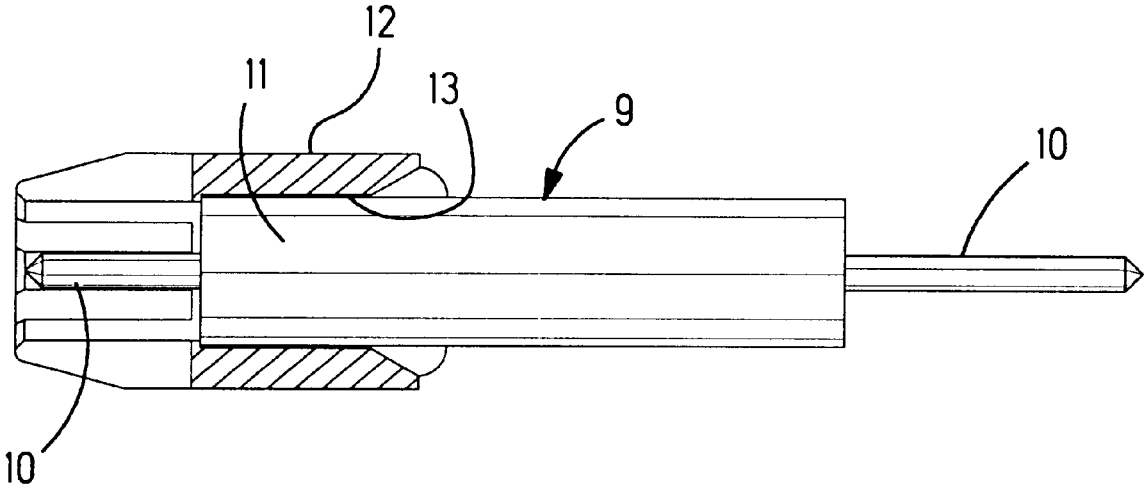
FIG. 11 is a section view of a typical embodiment of a feed for the upper patch element.
Figure 12:
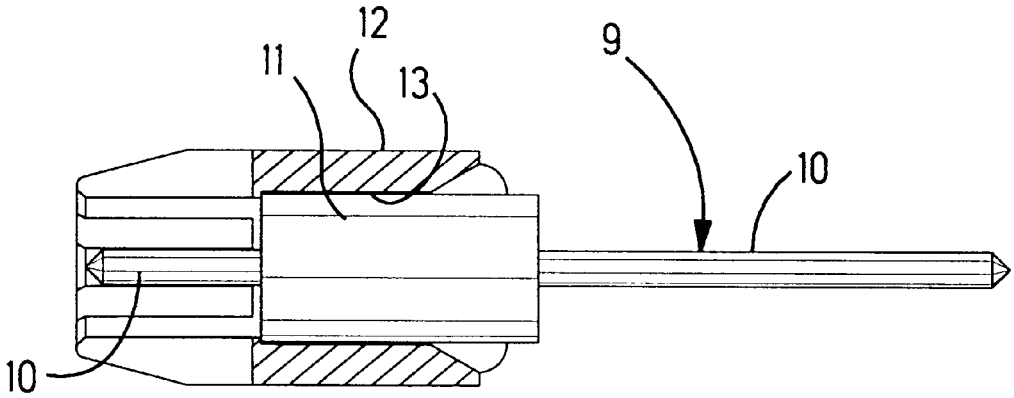
FIG. 12 is a section view of a feed for the lower patch element.

With reference to FIGS. 11 and 12, each feed 9 comprises a central conductor 10. The feed 9 for the upper patch element 2 is coaxial, wherein, the central conductor is concentrically encircled by an outer conductor 11, and a dielectric, not shown, concentrically between the central conductor 10 and the outer conductor 11. As shown in FIG. 12, the feed 9 for the lower patch element 3 is shown as being coaxial in construction. The feed 9 for the lower patch element 3 requires at least a central conductor 10, and need not be of coaxial construction.

Figure 13:
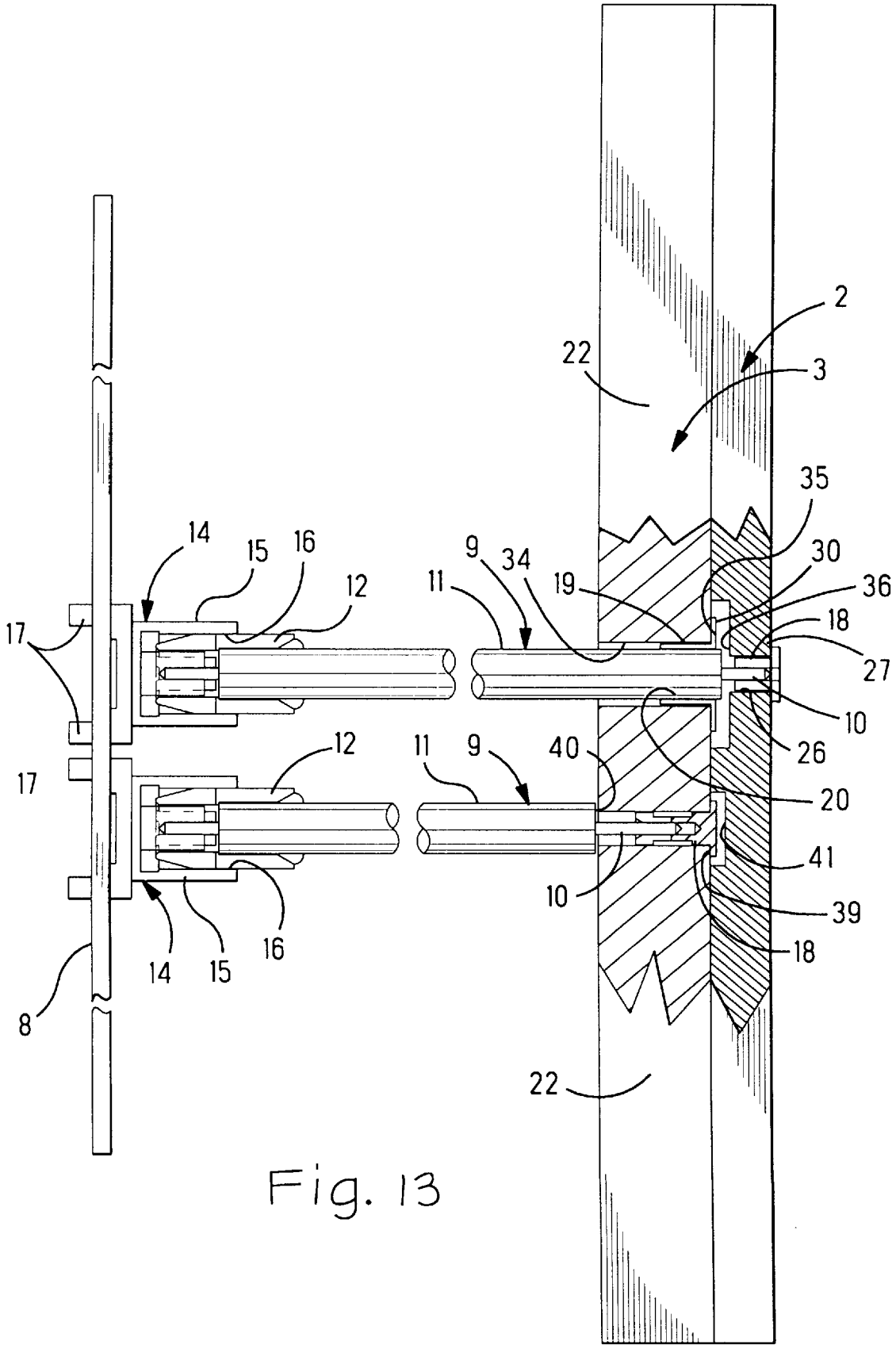
FIG. 13 is an enlarged side view of a portion of the antenna as shown in FIG. 4, with selected parts cut away.

For example, the coaxial feed 9 is constructed from a coaxial cable. Each end of the cable is trimmed back, to provide an exposed, projecting central conductor 10. One end of the cable is concentrically encircled by a conducting sleeve socket 12 that is connected, for example, by a solder joint 13 to the outer conductor 11. With reference to FIG. 13, the same end of the cable is terminated by an electrical connector 14. The connector 14 comprises, for example, a metal shell 15 connected to the sleeve socket 12, for example, by a solder joint 16, and concentrically encircling the sleeve socket 12 that encircles the end of the cable. Conducting legs 17 on the shell 15 secure in the thickness of the circuit board 8 that comprises a ground plane of the antenna 1.

With reference to FIG. 13, the other end of each feed 9 comprises a conducting basket 18 that resiliently grips the projecting central conductor 10 to establish an electrical connection. The basket 18 comprises, an electrical receptacle with spring fingers that grip the central conductor 10. The basket 18 is flanged to seat against a corresponding patch 2 or 3. The shorter feed 9, FIG. 12, connects to the lower patch 3. The longer feed 9, FIG. 11, passes through the lower patch element 3 and connects to the upper patch element 2. The longer feed 9 passes through a conducting flanged sleeve 19, FIG. 13, that seats against the lower patch element 3. The sleeve 19 is connected to the outer conductor 11 of the longer feed 9, for example, by a solder joint 20.

Figure 5:
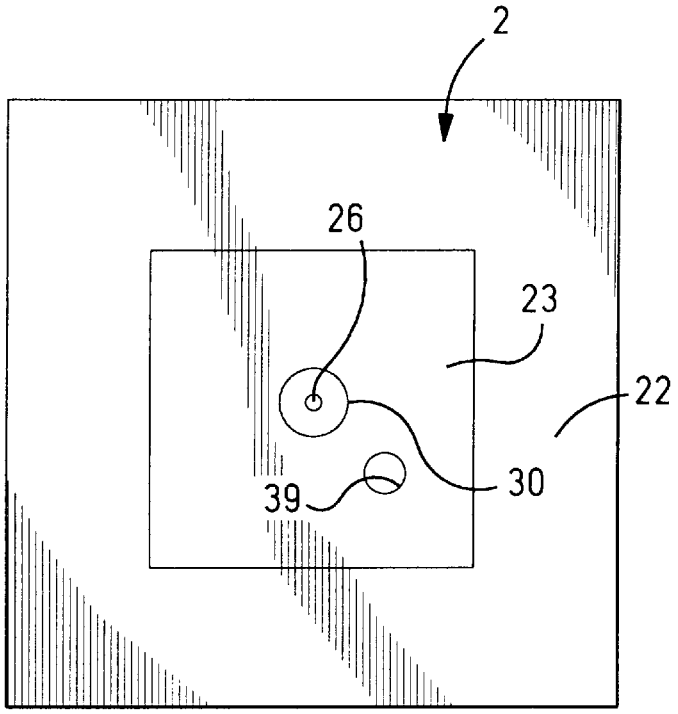
FIG. 5 is a bottom view of an upper patch element with an optional ground conductor.
Figure 6:
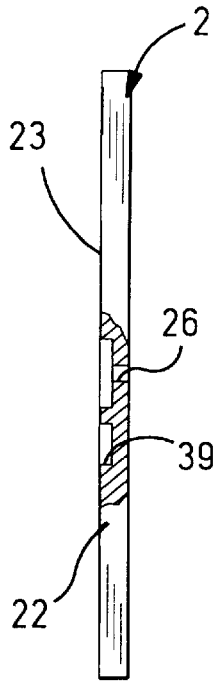
FIG. 6 is an edge view of the patch element as shown in FIG. 5.
Figure 8:
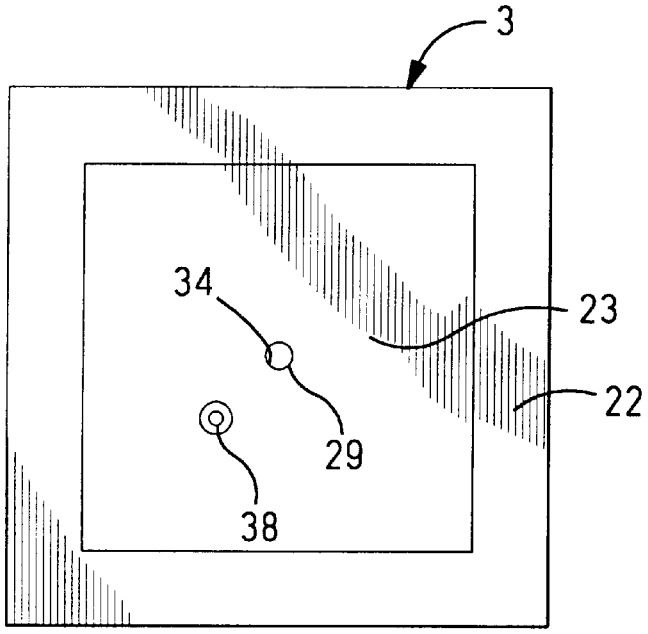
FIG. 8 is a bottom view of a lower patch element.
Figure 9:
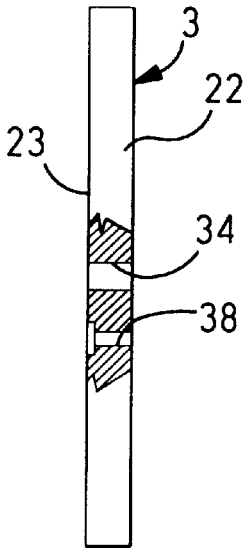
FIG. 9 is an edge view of the patch element as shown in FIG. 8 with parts cut away.

Features of each upper patch element 2 will now be described with reference to FIGS. 5, 6 and 7, which includes similar features of each lower patch element 3, FIGS. 8, 9 and 10. Each patch element 2, 3 acts as a parallel plate microstrip transmission line. Each patch element 2, 3 comprises, a conducting patch pattern 21 plated on a top surface of an insulating substrate 22, and a conducting ground conductor 23 on a bottom surface of the substrate 22. The substrate 22 happens to extend beyond the outer edges of the patch pattern 21 and the ground conductor 23. The description herein applies to many shapes and configurations, although the embodiment as illustrated in the drawings comprises a solid rectangular patch element 2.

Figure 7:
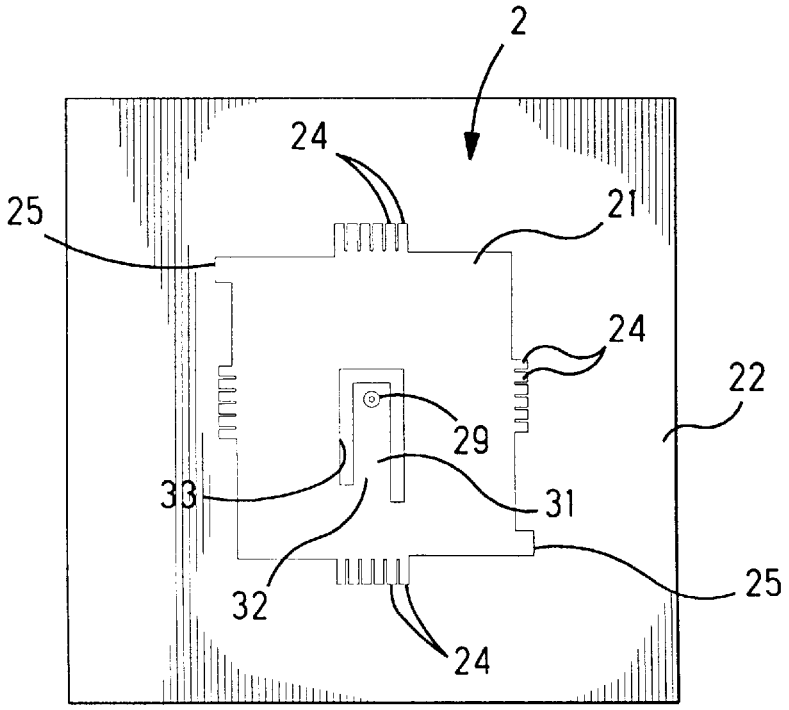
FIG. 7 is a top view of the patch element as shown in FIG. 5.
Figure 10:
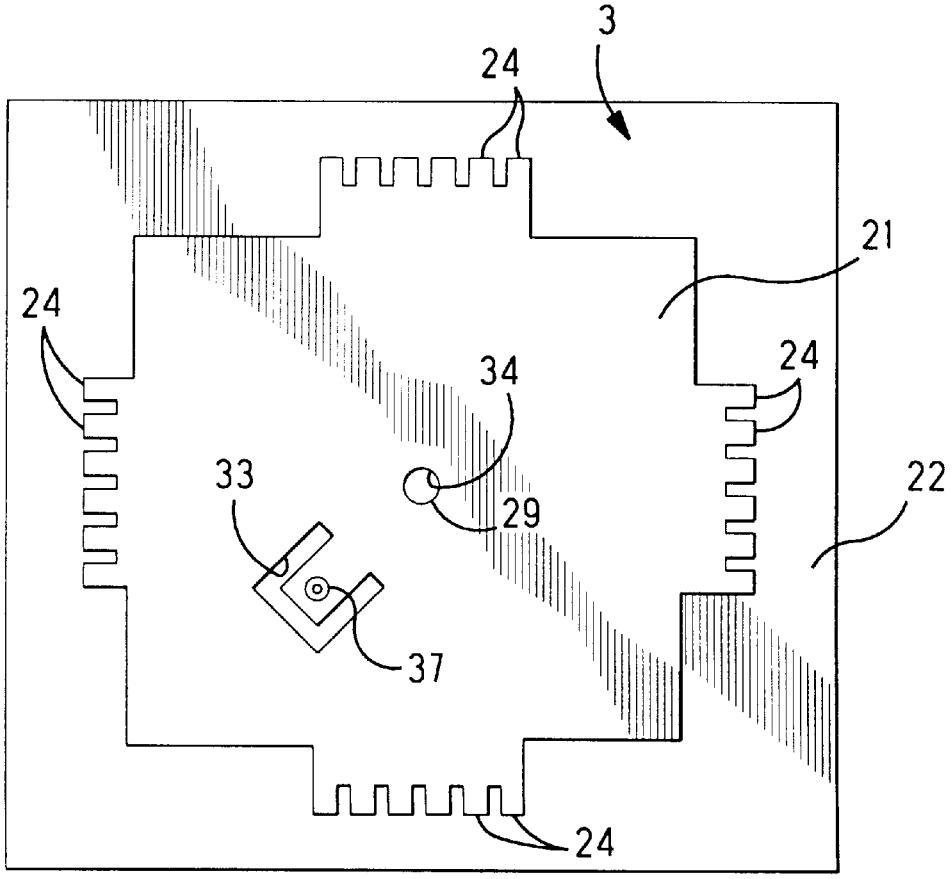
FIG. 10 is a top view of the patch element as shown in FIG. 8.

The characteristic impedance of the patch element 2 is determined by segments 24 and the slot 33, FIGS. 7 and 10, defining parallel field cell transmission lines provided at corresponding edges of the directly fed, corresponding patch element 2, 3. A revolving circularly polarized radiation pattern on the top patch element 2, 3 is produced by projecting polarization tabs 25 on the corresponding patch pattern 21 on the top patch element 2. On the bottom patch element 3, the radiation pattern is created by the feed, FIG. 10. The tabs 25 project in the same polar orientation about a polar axis of symmetry of the patch element 2.

For example, a polar axis of symmetry of the patch element 2 coincides with a center of the solid rectangular patch element 21. The thickness of the substrate 22 is proportional to small fraction of a wavelength corresponding to an optimum frequency for an operating band of frequencies. The lower patch element 3 has a thicker substrate 22 than that of the upper patch element 2 to correspond with separate operating bands of frequencies. The size of the patch pattern 21 on the lower patch element 3 differs from that on the upper patch element 2 to separate the operating frequency bands of the respective patch elements 2, 3.

The upper patch element 2 will now be discussed with reference to FIGS. 5, 6 and 7. The upper patch element 2 has a central passage 26 through its thickness to receive the coaxial feed 9 and the corresponding basket 18, FIG. 13. The basket 18 connects electrically with the patch pattern 21, for example, by a solder joint 27. According to the embodiment shown in FIG. 6, the upper patch element 2 is provided with an optional ground conductor 23, which need not be present, because the lower patch element 3 is referenced to ground and serves to reference the upper patch pattern on the upper patch element 2 to ground. The lower patch element 3 has a patch pattern that is larger in area than the optional ground conductor 23, such that, the ground conductor 23, if present, connects with the patch pattern of larger area by a pressure connection, for example, that adequately references the top patch element 2 to ground. The outer conductor 11 of the coaxial feed 9 connects with the ground conductor 23, if present on the patch element 2, for example, by a pressure connection 28.

The coaxial feed 9 is coupled by its center conductor 10 directly to a null point 29, FIG. 7, of the directly fed, upper patch element 2. The null point 29 is within the boundaries of the patch element 2. In the embodiment, for example, the null point 29 happens to coincide with the polar axis of symmetry, and with the center of the upper patch element 2, the patch element 2 being fed by a center, null point feed connection. On the bottom surface of the substrate 22, the ground conductor 23, if present, is continuous, without a corresponding gap, to a center fed, null point feed connection 30 with the outer conductor 11 of the coaxial feed 9. Secondary excitations tend to reform, before being radiated at the normal mode, when the upper patch element 2 is fed at the null point 29. The null point feed connection electrically isolates the operating frequency band of the upper patch element 2 from electrical influences of secondary excitations transmitted by the coaxial feed 9.

The null point feed connection would be ineffective to activate the patch element 2 as a normal mode antenna. According to the embodiment as shown in FIG. 7, a portion 31 of the upper patch element 2 extends the null point 29 of the upper patch element 2 to a natural feed point 32 on the upper patch element 2. The natural feed point is within the boundaries of the upper patch element 2, and is moved in from a nearest edge of the upper patch element 2 to adjust for an impedance match. The portion 31 of the directly fed patch element 2 comprises, a narrow microstrip transmission line extending from, and including, both the null point 29 and the natural feed point 32. A gap 33 separates the microstrip transmission line from the remainder of the upper patch element 2. On the bottom surface of the substrate 22, the ground conductor 23, if present, is continuous, without a corresponding gap, to the center fed, null point feed connection with the outer conductor 11 of the coaxial feed 9. The center of the lower patch element 3 serves as the ground for the upper patch element 2. The feed of the upper patch element 2 is extended to the natural feed point 32 to activate the upper patch element 2 as a normal mode radiating antenna operating with a separate band of operating frequencies. The coaxial feed 9 presents a specific characteristic impedance line that feeds the upper patch element while isolating the operating band of frequencies from electrical influences transmitted along the outer conductor 11 of the coaxial feed 9.

The lower patch element 3 will now be described with reference to FIGS. 8, 9 and 10. The lower patch element 3 has a central passage 34 through its thickness to receive the corresponding coaxial feed 9, FIG. 11, and the flanged sleeve 19, FIG. 13. The patch pattern 21, FIG. 10, is connected, for example, by a solder joint 35, FIG. 13, at its null point 29, to the flanged sleeve 19 that is connected to the outer conductor 11 of the coaxial feed 9. A recess 36 in the ground conductor 23, if present, of the upper patch element 2 provides a clearance space around the connection of the null point 29 of the lower patch pattern 21.

The outer conductor 11 of the coaxial feed 9 connects with the ground conductor 23 on the lower patch element 3. The coaxial feed 9 is coupled directly to the lower patch element 3 at the null point 29. The null point 29 is within the boundaries of the lower patch element 3. In the embodiment, for example, the null point 29 happens to coincide with the polar axis of symmetry, and with the center of the lower patch element 3. The ground conductor 23 of the lower patch element 3 is continuous to the center, null point 29 where the ground conductor 23 connects with the outer conductor 11 of the coaxial feed 9 to establish a null point connection. The lower patch element 3 is referenced to ground by being coupled at its null point 29 to the coaxial feed 9 to which the lower patch element 21 and the ground conductor 23 of the lower patch element 3 are connected.

Grounding the lower patch element 3 at its null point 29 to the outer conductor 11 of the coaxial feed 9, presents an inductance to ground, and provides a coaxial feed 9 of specific characteristic impedance to the null point connection of the same coaxial feed 9 with the upper patch element 2. Isolation is achieved by the null point connection that electrically isolates the operating band of frequencies of the lower patch element 3 from secondary influences transmitted by the feed 9, whether or not the feed 9 is coaxial in construction, due to the secondary excitations tending to reform, before being radiated, when fed at the null point 29.

Inherent isolation of the operating bands of frequencies is attained by coupling a null point 29 of a patch element 3 with a coaxial feed 9 that is referenced to ground and that presents a coaxial feed 9 of low impedance to the null point 29 of the lower patch element 3. Inherent isolation of the operating bands of frequencies is attained by coupling a patch element 3 at its null point 29 with a coaxial feed 9 that is referenced to ground and that directly feeds another patch element 2.

The lower patch element 3 is separately fed, for example, by a separate coaxial feed 9, FIGS. 12 and 13. The coaxial feed 9 for the lower patch element 3 extends to a natural feed point 37, FIG. 10, which is adjusted in position from a closest edge of the patch pattern 21 to adjust for impedance compensation. A passage 38 through the thickness of the lower patch element 3 receives the coaxial feed 9 and the corresponding basket 18. The patch pattern 21 is connected, for example, by a solder joint 39, FIG. 13, to the basket 18 that is, in turn connected to the central conductor 10 of the separate coaxial feed 9. The ground conductor 23 of the lower patch element 3 is connected, for example, by a solder joint 40, to the outer conductor 11 of the separate coaxial feed 9. A recess 41, FIGS. 5 and 13, in the upper patch element 2 provides a clearance around the separate coaxial feed 9 for the lower patch element 3.

Although a preferred embodiment is disclosed, other embodiments and modifications of the invention are intended to be covered by the spirit and scope of the appended claims.

What is claimed is:

1. A stacked patch antenna comprising: multiple patch elements at respective operating frequency bands being coupled at their respective null points with a coaxial feed, an outer conductor of the coaxial feed being referenced to ground, a central conductor of the coaxial feed being coupled directly to one of the null points of a directly fed one of the patch elements, and said one of the null points being connected to a natural feed point on the directly fed one of the patch elements by a portion of the directly fed one of the patch elements.

2. A stacked patch antenna as recited in claim 1 wherein, a separate feed is connected to a natural feed point on another of the patch elements, and said another of the patch elements is inductively coupled at a null point with the outer conductor of the coaxial feed to isolate the operating frequency bands.

3. A stacked patch antenna as recited in claim 1 wherein, another patch element is capacitively coupled at a null point with the outer conductor of the coaxial feed to isolate the operating frequency bands.

4. A stacked patch antenna as recited in claim 1 wherein, another patch element is capacitively coupled at a null point with the outer conductor of the coaxial feed, and said another patch element provides a ground conductor for the directly fed one of the patch elements.

5. A stacked patch antenna as recited in claim 1 wherein, corresponding edges of the directly fed patch element are provided with segments defining parallel field cell transmission lines.

6. A stacked patch antenna comprising: a conducting upper patch element having a null point within the boundaries of the upper patch element, the upper patch element having a natural feed point within the boundaries of the upper patch element, a conducting microstrip portion of the upper patch element connecting between the null point and the natural feed point, a coaxial feed connected to the null point, a concentric shield of the coaxial feed presenting an inductance to ground referenced at a ground plane, a lower patch element inductively coupled to the shield at a null point of the lower patch element, and a separate feed connected to a natural feed point on the lower patch element.

7. A stacked patch antenna comprising: a first patch element, a coaxial feed connected to a null point on the first patch element, a portion of the first patch element connecting the null point with a natural feed point on the first patch element, and the coaxial feed passing through a null point on a separately fed second patch element, the second patch element comprising a patch and a ground conductor connected to the coaxial feed and referenced to ground by the coaxial feed, and a separate feed connected to the second patch element.

8. A stacked patch antenna comprising: an upper patch element fed by a coaxial feed, the coaxial feed passing through a lower patch element, the lower patch element connecting with the coaxial feed and being referenced to ground by the coaxial feed, and a separate feed connected to the lower patch element.

9. A stacked patch antenna comprising: a patch element fed by a coaxial feed, the coaxial feed being connected to a null point on the patch element, a portion of the patch element connecting the null point with a natural feed point on the patch element, another patch element, and a separate feed for said another patch element.

10. A stacked patch antenna as recited in claim 9 wherein, the separate feed is connected to a natural feed point for said another patch element.

11. A stacked patch antenna as recited in claim 9 wherein, the separate feed comprises another coaxial feed.

12. A stacked patch antenna as recited in claim 9 wherein, said another patch element comprises, a patch and a ground conductor connected to the coaxial feed and referenced to ground by the coaxial feed.

13. A stacked patch antenna as recited in claim 9 wherein, the coaxial feed passes through a null point on said another patch element.

14. A stacked patch antenna as recited in claim 9 wherein, the coaxial feed connects with said another patch element and is referenced to ground.

15. A stacked patch antenna comprising: separately fed patch elements coupled at their respective null points with a coaxial feed, the coaxial feed feeding a first of the patch elements, a respective null point and a natural feed point on one said patch elements being connected by a portion of said first of the patch elements to be fed by the coaxial feed, and a second of said patch elements being referenced to ground by the coaxial feed.

* * * * *